United States Patent [19]

Cherrington

[11] 4,121,673

[45] Oct. 24, 1978

[54] DRILLING AND INSTALLATION SYSTEM

[76] Inventor: Martin Dee Cherrington, 5147 Whitney Ave., Carmichael, Calif. 95608

[21] Appl. No.: 740,573

[22] Filed: Nov. 10, 1976

[51] Int. Cl.[2] ..... E21B 7/04

[52] U.S. Cl. ..... 175/61; 175/75; 299/33

[58] Field of Search ..... 175/26, 45, 61, 73, 175/75, 171, 62; 61/84, 85, 72.4, 113; 299/31, 33

[56] References Cited

U.S. PATENT DOCUMENTS

| | | | |
|---|---|---|---|
| 2,565,794 | 8/1951 | Young | 175/61 |
| 3,280,923 | 10/1966 | Muench | 175/73 |
| 3,356,167 | 12/1967 | Trent | 175/62 X |
| 3,465,834 | 9/1969 | Southworth, Jr. | 175/73 X |
| 3,713,500 | 1/1973 | Russell | 175/73 |
| 3,857,449 | 12/1974 | Kimura | 175/26 |
| 3,938,597 | 2/1976 | Richmond et al. | 175/61 X |
| 3,967,463 | 7/1976 | Grandori | 299/33 |

*Primary Examiner*—Ernest R. Purser

*Assistant Examiner*—Richard E. Favreau

*Attorney, Agent, or Firm*—Townsend and Townsend

[57] ABSTRACT

A system for drilling and simultaneously installing a relatively large production casing along an invert underground arcuate path beneath an obstacle is disclosed. A plurality of production casing segments, each having preformed curvature corresponding to the radius of the curvature of the arcuate path, are joined end to end and advanced along the desired path. A drill head is located in front of the leading end of the casing. The drill head is mounted to the casing so that the angular orientation of the drill head relative to the axis of the leading end of the casing is at least partially adjustable. A drill bit is located in front of the drill head and a motor is located within the drill head to drive the drill bit. The drill bit excavates a passageway along the arcuate path in advance of the casing. The angular orientation of the drill head relative to the axis of the leading end of the casing is controlled so that the passageway is excavated along the preselected arcuate path and the casing is simultaneously installed along that path.

9 Claims, 3 Drawing Figures

DRILLING AND INSTALLATION SYSTEM

BACKGROUND OF THE INVENTION

The present invention relates to a system for drilling and simultaneously installing a relatively large production casing along an invert underground arcuate path beneath an obstacle.

Various types of systems for drilling and installing production casings along an invert underground arcuate path beneath an obstacle have been developed by this inventor. Such systems are perhaps typified by U.S. Pat. No. 3,894,402, issued to this inventor. In such systems, a pilot hole is first drilled at least partially along the preferred path beneath the obstacle, as described in U.S. Pat. No. 3,878,903. A larger production casing is then installed along the path of the original pilot hole.

The systems described above have represented a substantial advance in the state of the art of drilling technology, as described in the above-referenced patents. However, it has been found that certain difficulties arise when relatively larger production casings, typically in excess of 16 inches in diameter, are to be installed along the length of the pilot hole. An initial problem is that certain of the techniques previously used by this inventor require that the production casing itself be rotated. However, the rotation of a large diameter production casing when it is installed along a curved path is often unfeasible because of the strain on the casing and such techniques can only be used with smaller casings. Even when techniques are employed in which the production casing itself is not rotated, the fact that the production casing is much larger than the drill string occupying the pilot hole makes it difficult to have the production casing flex so that it can follow the drill string. Production casings now known and used are linear, and must actually flex to follow the pilot string along the curved path, which is quite difficult and often impossible when the production casing is of relatively large diameter.

SUMMARY OF THE INVENTION

The present invention provides a system for drilling and simultaneously installing a relatively large production casing along an invert underground arcuate path beneath an obstacle. A plurality of production casing segments, each having performed curvature corresponding to the radius of the curvature of the arcuate path, are joined end to end and advanced along the desired path. A drill head is located in front of the leading end of the casing. The drill head is mounted to the casing so that the angular orientation of the drill head relative to the axis of the leading end of the casing is at least partially adjustable. A drill bit is located in front of the drill head and a motor is located within the drill head to drive the drill bit. The drill bit excavates a passageway along the arcuate path in advance of the casing. The angular orientation of the drill head relative to the axis of the leading end of the casing is controlled so that the pasageway is excavated along the preselected arcuate path and the casing is simultaneously installed along that path.

The system of the present invention avoids the problems enumerated above which are encountered with respect to other techniques developed by this inventor when large production casings are to be installed. Specifically, the casing is not rotated and the casing itself is curved so that it need not be flexed to follow the preferred arcauate path. In addition, the system of the present invention eliminates the two stage construction previously used in which a pilot hole was drilled prior to installation of the production casing, and with the system of the present invention, the casing is installed in a single step. The excavating system of the present invention is controlled and the guidance provided by a pilot hole is not necessary. The casing may be weighted to neutralize its buoyancy so that the casing floats into the hole, facilitating its installation and minimizing any damge to the casing, as described in my copending application entitled SYSTEM AND METHOD FOR INSTALLING PRODUCTION CASINGS, filed Nov. 10, 1976, Ser. No. 740,570.

The novel features which are characteristic of the invention, as to organization and method of operation, together with further objects and advantages thereof will be better understood from the following description considered in connection with the accompanied drawings which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
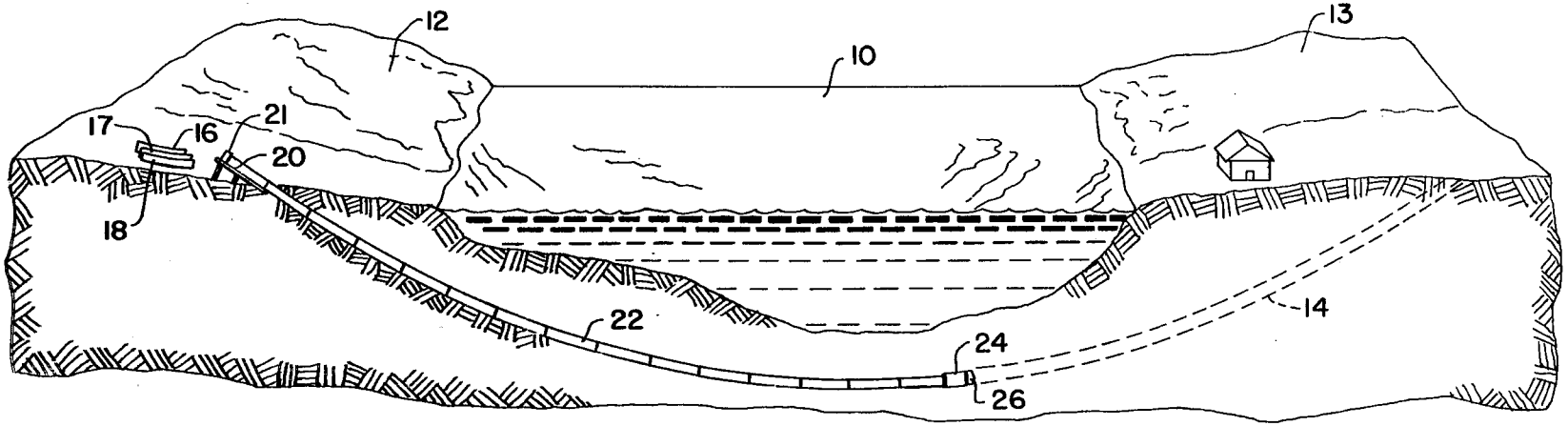
FIG. 1 is a perspective cut-away view of the system of the present invention.

Referring initially to FIG. 1, a river 10 is depicted which is to be spanned by a production casing such as an oil conduit, utility line or the like. The casing is to span the river from near ground level on its banks 12, 13. To span river 10, the production casing must follow an invert underground arcuate path depicted by lines 14 and having a generally constant radius of curvature from a first position at ground level of bank 12 on one side of the river to a second position at ground level on bank 13 on the other side.

A plurality of production casing segments 16–18 are provided on bank 12 of river 10. Casing segments 16–18 typically have a relatively larger diameter, usually in excess of 16 inches, and for the purposes of the present invention, the casing segments are each precurved so as to have a radius of curvature corresponding with the radius of curvature of path 14. A ramp 20 is provided on bank 12 and segments 16–18 are loaded onto the ramp and joined end to end with other such casing segments to form a continuous production casing 22 which is advanced along path 14. A drill head 24 and drill bit 26 are located in front of the leading end of casing 22 to excavate a passageway 56 for the casing as it is advanced along path 14 by advancing mechanism 21.

Figure 2:
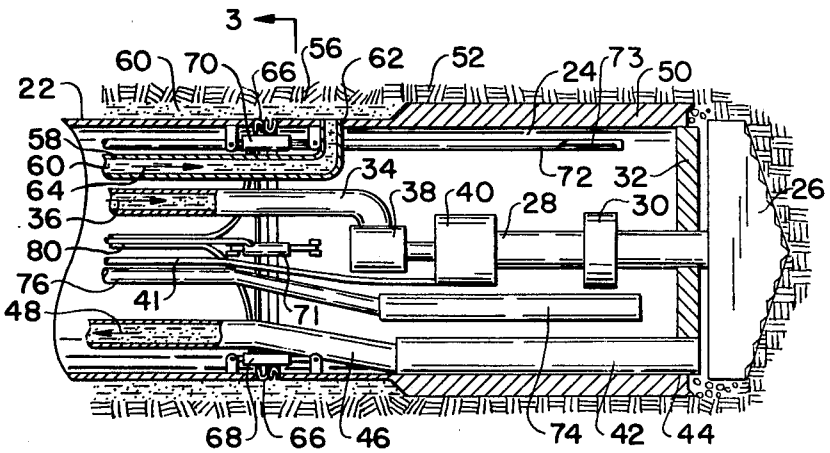
FIG. 2 is a cross-sectional elevation view of the excavating apparatus of the present invention.
Figure 3:
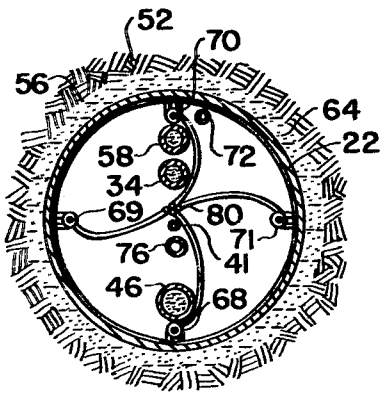
FIG. 3 is a sectional view taken along lines 3—3 of FIG. 2.

Drill head 24, drill bit 26, and casing 22 are further illustrated by way of reference to FIGS. 2 and 3. Drill bit 26 is mounted on a shaft 28 held in place by bearing pack 30. Shaft 28 extends through a plate 32 at the front of drill head 26 which seals off the interior of drill head 24 and casing 22 from passageway 56 itself.

A conduit 34 is provided which passes through the interior of casing 22 from its trailing end. Drilling mud is injected into the trailing end of conduit 34 and passes along the conduit as illustrated by arrow 36. Conduit 34 terminates in a fluid coupling 38 which supplies the drilling mud to the excavation site at drill bit 26 to entrain the cuttings from the drill bit. Hydraulic motor 40 is driven through line 41 to operate drill bit 26.

A positive displacement pump 42 is located within drill head 26 and communicates with a port 44 in plate 32. The used drilling mud with entrained cuttings is drawn into the interior of drill head 24 by positive displacement pump 42, and evacuated through conduit 46 in casing 22 as depicted by arrow 48. A pack-off blade 50 circumscribes drilling head 24 and forms a sealing contact with the circumscribing ground 52 so that substantially all of the used drilling mud and entrained drillings are collected in drill head 24 and evacuated through conduit 46.

To facilitate movement of casing 22 and drill head 24 as they are advanced along the passageway 56 excavated by drill bit 26, a conduit 58 for lubricating mud 60 is provided along the interior of casing 22, and terminates at a port 62 in a side wall of drill head 24. Lubricating mud 60 is injected along conduit 58 as illustrated by arrow 64 and is expelled into the annular void between casing 22 and circumscribing ground 52 to lubricate the passage of casing 22 along passageways 56.

Drill head 24 is joined to casing 22 by a flexible, bellows-type joint 66. Joint 66 allows drill head 24 to move slightly so that its angular orientation with respect to the central axis of the leading end of casing 22 is adjustable. A plurality of hydraulic actuators 68–71 operated through line 80 span flexible joint 66 and can be expanded and contracted to adjust the angular orientation of drill head 24.

An inertial guidance system or other type of sensor 73 can be inserted near the leading end of casing 22 along a conduit 72. The sensor determines the position of drill head 24, and if the drill head is deviating from the preferred path 14, the orientation of the drill head can be adjusted accordingly.

A sump pump 74 can be located within drill head 24 to evacuate through conduit 76 any water or other liquids which seep into the leading end of casing 22 and drill head 24. As a result, casing 22 will be buoyant and will tend to be forced against the top of passageway 56. However, the wall thickness of the casing, the size of the various conduits passing therethrough, and the contents of these conduits, can be selected to neutralize as nearly as possible any such buoyant effect. If the buoyancy is so neutralized, casing 22 will float in the lubricating mud 60 occupying passageway 56 and the casing will slip easily into the hole, as more fully described in my copending patent application for SYSTEM AND METHOD FOR INSTALLING PRODUCTION CASINGS referenced above.

In operation, a path 14 having generally a constant radius of curvature is selected which will span river 10 from one bank 12 to the other 13. A plurality of large diameter production casings such as 16–18 are provided which are precurved and have a radius of curvature generally equal to that of path 14.

Drill head 24 and its associated drill bit 26 are mounted on the leading end of the first casing segment, and the excavation of a passageway from one bank 12 of river 10 is initiated. Additional conduit segments are added on to the initial segment to provide a continuous curved casing 22 which is advanced along the passageway excavated by drill bit 26. As the passageway is being excavated, the contents of casing 22, including the various supply and discharge conduits and possibly other weighing elements, are monitored and controlled so that buoyancy of casing 22 is neutralized and it floats readily into the excavated passageway. The orientation of drill head 24 is controlled so that the preferred arcuate path 14 is followed as closely as possible so that precurved casing 22 need not flex as it is installed along the preferred path.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. Apparatus for drilling and simultaneously installing a relatively large production casing along an invert underground arcuate path beneath an obstacle from a first position at or near ground level on one side of the obstacle to a second position at or near ground level at the other side of the obstacle comprising: a plurality of production casing segments each having preformed curvature corresponding to the radius of curvature of said arcuate path, said casing segments adapted to be joined end to end to form a continuous production casing; means for advancing said casing along said path from said first position; a drill head located in front of the leading end of the casing; means for mounting the drill head to the casing so that the angular orientation of the drill head relative to the axis of the leading end of the casing is at least partially adjustable; a drill bit located in front of the drill head and mounted thereto; means within the drill head for driving the drill bit to excavate a passageway along said path in advance of the casing; and means for controlling the angular orientation of the drill head relative to the axis of the leading end of the casing so that the passageway is excavated along said path from said first position to a second position and the casing is installed therealong; a conduit for lubricating mud within the casing fluidly communicated to the exterior of the casing proximate the leading end thereof; and means for injecting lubricating mud through the lubricating mud conduit so that the lubricating mud is expelled proximate the leading end of the casing to lubricate the casing as it is advanced along the excavated passageway.

2. Apparatus as recited in claim 1 wherein said controlling means includes a plurality of hydraulic actuators spanning the mounting means from the casing to the drill head and disposed circumferentially about the casing and the drill head, and means for extending and contracting the actuators to control the angular orientation of the drill head relative to the axis of the leading end of the production casing.

3. Apparatus as recited in claim 1 wherein said driving means comprises a hydraulic motor located within the drill head and adapted to power the drill bit; and additionally comprising a supply conduit for drilling mud passing through the interior of the casing and connected with the hydraulic motor to supply drilling mud to and thereby use the drilling mud to drive the hydraulic motor, said used drilling mud being expelled at the drill bit to entrain cuttings from the excavated passageway and means for collecting the drilling mud and entrained cuttings at the drill head and impelling the drilling mud and entrained cuttings under positive pressure rearwardly out of the casing.

4. Apparatus as recited in claim 1 and additionally comprising a conduit for lubricating mud within the casing fluidly communicated to the exterior of the casing proximate the leading end thereof; and means for injecting lubricating mud through the lubricating mud conduit so that the lubricating mud is expelled proximate the leading end of the casing to lubricate the casing as it is advanced along the excavated passageway.

5. Apparatus according to claim 1 and wherein said drill head excavates a diameter greater than the diameter of said casing.

6. The apparatus of claim 1 and including a seal between said drill bit and said conduit for lubricating mud for isolating said lubricating mud from said drill bit.

7. A method for emplacing a casing beneath an obstacle between first and second locations at or near ground level comprising the steps of excavating a passageway in liquid premeated soil formations having a preselected diameter along an invert arcuate path having a generally constant radius of curvature under said obstacle between said locations; providing a plurality of casing segments each having a preformed radius of curvature corresponding to the radius of curvature of the arcuate path; joining said casing segments end to end to form a continuous curved casing; introducing a transport fluid at the site of said excavating; entraining the cuttings from said excavating in the transport fluid; nonrotatably advancing said casing into and along the arcuate path of said passageway; collecting said transport fluid and entrained cuttings in the interior of the leading portion of said casing; evacuating the transport fluid and entrained cuttings under positive pressure from the interior of the leading portion of said casing to prevent the cuttings from settling in the ground circumscribing the advancing casing; sealing off the interior of said casing proximate the leading portion thereof to provide buoyancy to the casing within the passageway; and weighting the casing to substantially neutralize said buoyancy to minimize friction between the casing and the sidewalls of the passageway to facilitate advancement of said casing into the passageway.

8. A method according to claim 7 wherein said excavating step comprises drilling the passageway with a drill located in front of the casing.

9. A method according to claim 7 wherein the diameter of the passageway is greater than the diameter of the casing, and additionally comprising the step of injecting lubricating mud into the annular void between the casing and the sidewalls of the passageway to lubricate the casing as it moves along the passageway.

* * * * *